US008834186B2

(12) United States Patent
Lo et al.

(10) Patent No.: US 8,834,186 B2
(45) Date of Patent: Sep. 16, 2014

(54) POWER SOCKET AND SAFETY GATE MECHANISM THEREOF

(71) Applicant: Askey Computer Corp., New Taipei (TW)

(72) Inventors: Shih-Po Lo, New Taipei (TW); Tan-Lung Chen, New Taipei (TW)

(73) Assignee: Askey Computer Corp., New Taipei (TW)

( * ) Notice: Subject to any disclaimer, the term of this patent is extended or adjusted under 35 U.S.C. 154(b) by 39 days.

(21) Appl. No.: 13/831,991

(22) Filed: Mar. 15, 2013

(65) Prior Publication Data

US 2014/0134860 A1 May 15, 2014

(30) Foreign Application Priority Data

Nov. 13, 2012 (TW) ..... 101142272 A

(51) Int. Cl.
*H01R 13/44* (2006.01)
*H01R 13/453* (2006.01)

(52) U.S. Cl.
CPC ..... *H01R 13/4534* (2013.01)
USPC ..... 439/140

(58) Field of Classification Search
USPC ..... 439/135–145
See application file for complete search history.

(56) References Cited

U.S. PATENT DOCUMENTS

| | | | | |
|---|---|---|---|---|
| 7,950,934 | B2 * | 5/2011 | Sallam et al. | 439/135 |
| 2010/0317208 | A1 * | 12/2010 | Chen et al. | 439/140 |
| 2013/0137283 | A1 * | 5/2013 | Lin | 439/140 |
| 2014/0030898 | A1 * | 1/2014 | Baldwin et al. | 439/140 |

* cited by examiner

*Primary Examiner* — Jean F Duverne
(74) *Attorney, Agent, or Firm* — Jianq Chyun IP Office

(57) ABSTRACT

A power socket includes a socket main body, a front cover and a safety gate mechanism. The front cover has two openings. The safety gate mechanism includes a casing and a safety gate. The casing located between the socket main body and the front cover has two inserted holes and a protrusion. The inserted holes are aligned with the openings. The safety gate slidably disposed at the casing is dislocated from the protrusion. When the safety gate is at a first position, the safety gate blocks the inserted holes, and two terminals of a plug push the safety gate through the two openings to make the safety gate slide to expose the inserted holes. When an object pushes the safety gate through one of the openings, the safety gate rotates to drive a part of the safety gate to be aligned with the protrusion to avoid exposing the inserted holes.

16 Claims, 6 Drawing Sheets

POWER SOCKET AND SAFETY GATE MECHANISM THEREOF

CROSS-REFERENCE TO RELATED APPLICATION

This application claims the priority benefit of Taiwan application serial no. 101142272, filed Nov. 13, 2012. The entirety of the above-mentioned patent application is hereby incorporated by reference herein and made a part of this specification.

BACKGROUND

1. Field of the Disclosure

The disclosure generally relates to a socket and a safety gate mechanism thereof, and more particularly, to a power socket and a safety gate mechanism thereof.

2. Description of Related Art

Electrical power has provided the modern family with a convenient and stable energy, but because the "electricity" is something invisible, an inadvertence may cause an electrical induction or a current leakage accident and then harm life and property. Especially in a family having preschoolers or little kids, in general, people must pay more attention to the safety of the electricity.

Children often insert a conductive object such as metallic utensil into a power outlet due to their curiosity nature. Such a power outlet can be, for example, a 110V/220V utility power socket, a power line communication socket (PLC socket) or other various types of power sockets. When the inadvertence occurs, the power socket get short circuit to damage the socket even brings up electricity risk of an electric shock. All these are very dangerous and people must pay great attention. Therefore, how to design an appropriate safety mechanism disposed in a power socket to avoid the user from mistakenly inserting a conductive object into the socket and from short circuit is an important issue in the design of power socket.

SUMMARY OF THE DISCLOSURE

Accordingly, the disclosure is directed to a power socket, in which a safety gate mechanism thereof can effectively avoid a conductive object from inserting into a socket main body.

The disclosure is also directed to a safety gate mechanism able to effectively avoid a conductive object from inserting into a socket main body.

The disclosure provides a power socket, which includes a socket main body, a front cover and a safety gate mechanism. The front cover has two openings. The safety gate mechanism includes a casing and a safety gate. The casing is disposed between the socket main body and the front cover and has two inserted holes and at least one protrusion, in which the two inserted holes are disposed correspondingly to the socket main body and respectively aligned with the two openings. The safety gate is slidably disposed at the casing and dislocated from the protrusion, in which when the safety gate is located at a first position, the safety gate blocks the two inserted holes, and two terminals of a plug push the safety gate through the two openings to make the safety gate slide to a second position to expose the two inserted holes; when an object pushes the safety gate through one of the two openings, the safety gate rotates to drive a part of the safety gate to be aligned with the protrusion so as to avoid exposing the two inserted holes.

The disclosure provides a safety gate mechanism suitable for a power socket, in which the power socket includes a socket main body and a front cover. The front cover has two openings. The safety gate mechanism includes a casing and a safety gate. The casing is disposed between the socket main body and the front cover and has two inserted holes and at least one protrusion, in which the two inserted holes are disposed correspondingly to the socket main body and respectively aligned with the two openings. The safety gate is slidably disposed at the casing and dislocated from the protrusion, in which when the safety gate is located at a first position, the safety gate blocks the two inserted holes, and two terminals of a plug push the safety gate through the two openings to make the safety gate slide to a second position to expose the two inserted holes; when an object pushes the safety gate through one of the two openings, the safety gate rotates to drive a part of the safety gate to be aligned with the protrusion so as to avoid exposing the two inserted holes.

In an embodiment of the disclosure, the safety gate mechanism further includes an elastic member, the elastic member is disposed between the safety gate and the casing, and the safety gate is configured to position-resume to the first position from the second position by means of elastic force of the elastic member.

In an embodiment of the disclosure, the safety gate has two sloped surfaces, the two terminals push the two sloped surfaces to drive the safety gate sliding to the second position from the first position.

In an embodiment of the disclosure, each of the terminals has a sloped surface and the terminal is configured to push the safety gate by the sloped surface so as to drive the safety gate sliding to the second position from the first position.

In an embodiment of the disclosure, the safety gate includes a pillaret, a first side portion and a second side portion. The pillaret is slidably disposed at the casing, in which the safety gate rotates around the pillaret. The first side portion and the second side portion are respectively connected to opposite two sides of the pillaret, in which when the safety gate is located at the first position, the first side portion and the second side portion are respectively aligned with the two openings, and the two terminals of the plug push the first side portion and the second side portion through the two openings so as to make the safety gate slide to the second position.

In an embodiment of the disclosure, the quantity of the at least one protrusion is two and the protrusions include a first protrusion and a second protrusion, when the object pushes the safety gate through one of the two inserted holes, the safety gate rotates to drive the first side portion to be aligned with the first protrusion or drive the second side portion to be aligned with the second protrusion.

In an embodiment of the disclosure, the casing has opposite two side walls, the safety gate is disposed between the two side walls, and the first protrusion and the second protrusion are respectively disposed at the two side walls.

In an embodiment of the disclosure, the casing has a bottom wall, a gap between the protrusion and the bottom wall is greater than a thickness of the safety gate, when the safety gate is located at the first position and dislocated from the protrusion, the safety gate is configured to slide to the second position by passing the gap.

Based on the description above, the power socket of the disclosure disposes a safety gate mechanism between the front cover and the socket main body thereof. When the user inserts two terminals of a plug into the power socket through the two openings of the front cover, the two terminals of the plug would push the safety gate of the safety gate mechanism to make the safety gate away from the two inserted holes on the casing of the safety gate mechanism, so that the two terminals can be inserted into the socket main body through the two inserted holes and the disposing of the safety gate mechanism would not hinder the connection between the plug and the power socket. On the other hand, the casing of the safety gate mechanism has protrusions, and when the user inserts an object (such as metallic utensil) into the power socket through one of the two openings of the front cover, the object would push the safety gate to rotate to make the safety gate aligned with the protrusions of the casing, so that the safety gate can be avoided to be pushed away from the inserted holes of the casing by the object by means of the blocking of the protrusions against the safety gate, and it can prevent the object from entering the socket main body to damage the power socket by short circuit. In this way, the disclosure can advance the operation safety of the power socket.

In order to make the features and advantages of the present disclosure more comprehensible, the present disclosure is further described in detail in the following with reference to the embodiments and the accompanying drawings.

DESCRIPTION OF THE EMBODIMENTS

Figure 1:
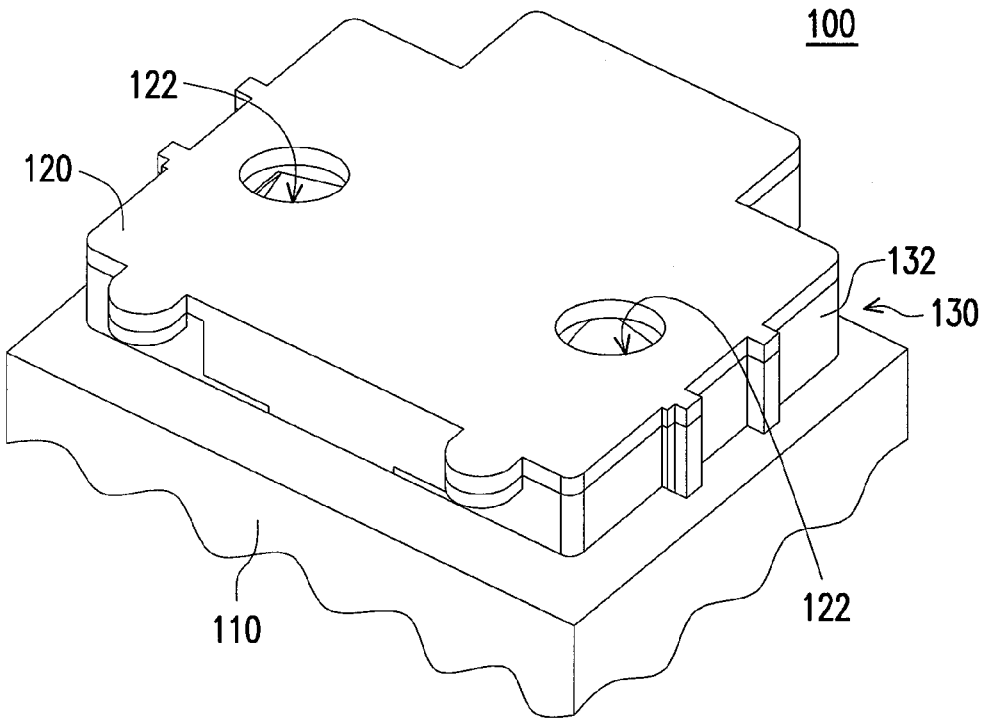
FIG. 1 is a schematic three-dimensional diagram of a power socket according to an embodiment of the disclosure.
Figure 2:
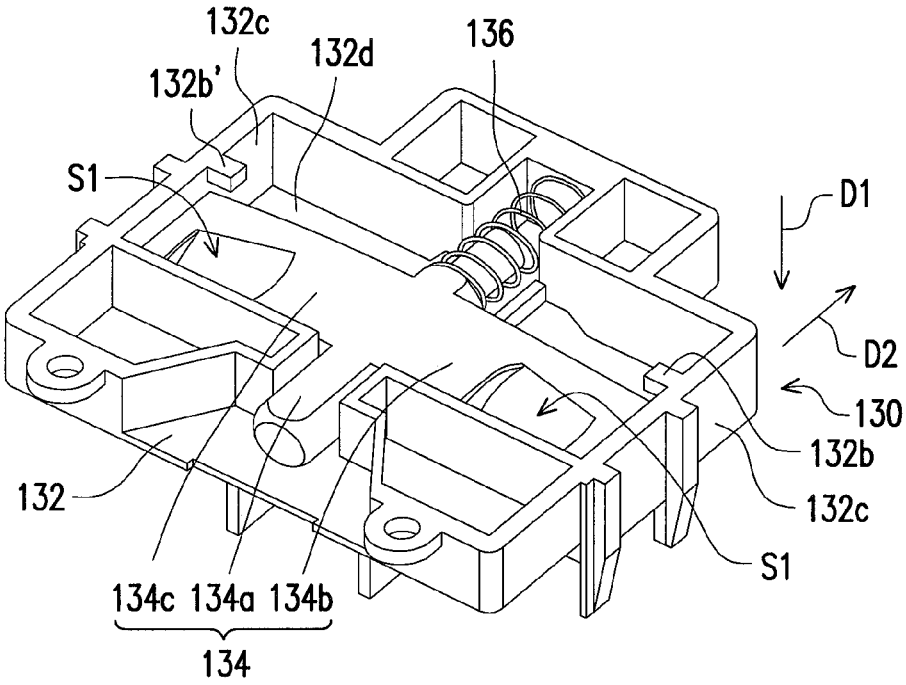
FIG. 2 is a schematic three-dimensional diagram of the safety gate mechanism in FIG. 1.
Figure 3:
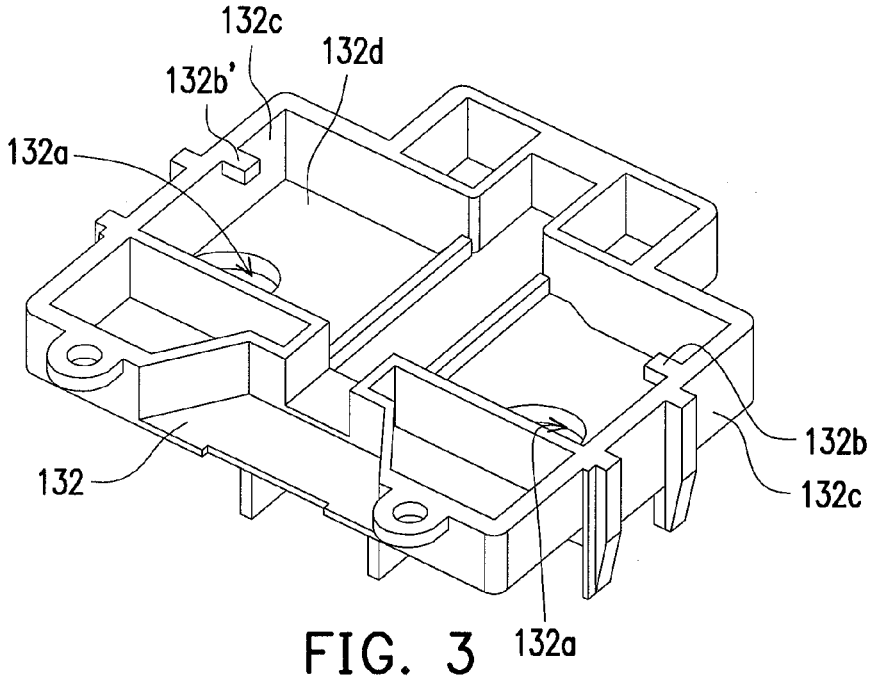
FIG. 3 is a schematic three-dimensional diagram of the casing in FIG. 2.

FIG. 1 is a schematic three-dimensional diagram of a power socket according to an embodiment of the disclosure, FIG. 2 is a schematic three-dimensional diagram of the safety gate mechanism in FIG. 1 and FIG. 3 is a schematic three-dimensional diagram of the casing in FIG. 2. In the embodiment, a power socket 100 includes a socket main body 110, a front cover 120 and a safety gate mechanism 130. The front cover 120 has two openings 122 for the terminals of a plug to be inserted into. In the embodiment, the power socket 100 is, for example, power line communication socket (PLC socket), or other types of power sockets, which the disclosure is not limited to.

The safety gate mechanism 130 includes a casing 132 and a safety gate 134. The casing 132 is disposed between the socket main body 110 and the front cover 120 and has two inserted holes 132*a* and at least one protrusion (in the figures, a first protrusion 132*b* and a second protrusion 132*b*' are shown). The two inserted holes 132*a* are disposed correspondingly to the socket main body 110 and respectively aligned with the two openings 122. The safety gate 134 is slidably disposed at the casing 132 and dislocated from the first protrusion 132*b* and the second protrusion 132*b*'.

Figure 4:
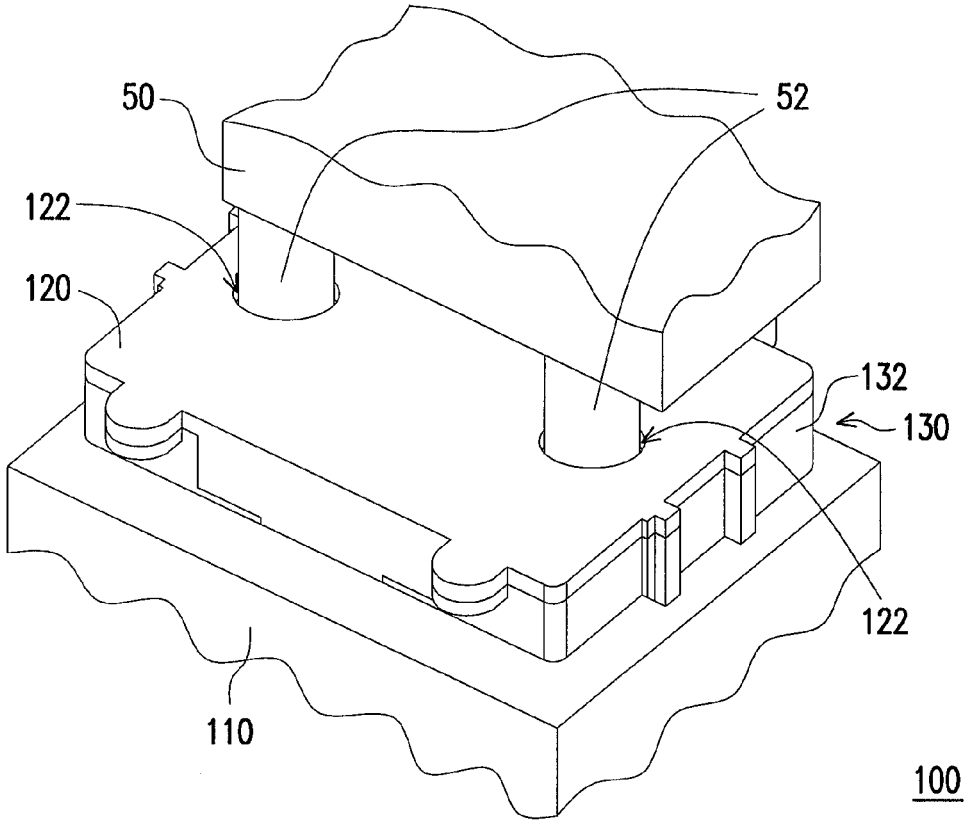
FIG. 4 is a diagram showing two terminals of a plug respectively insert the two openings in FIG. 1.
Figure 5:
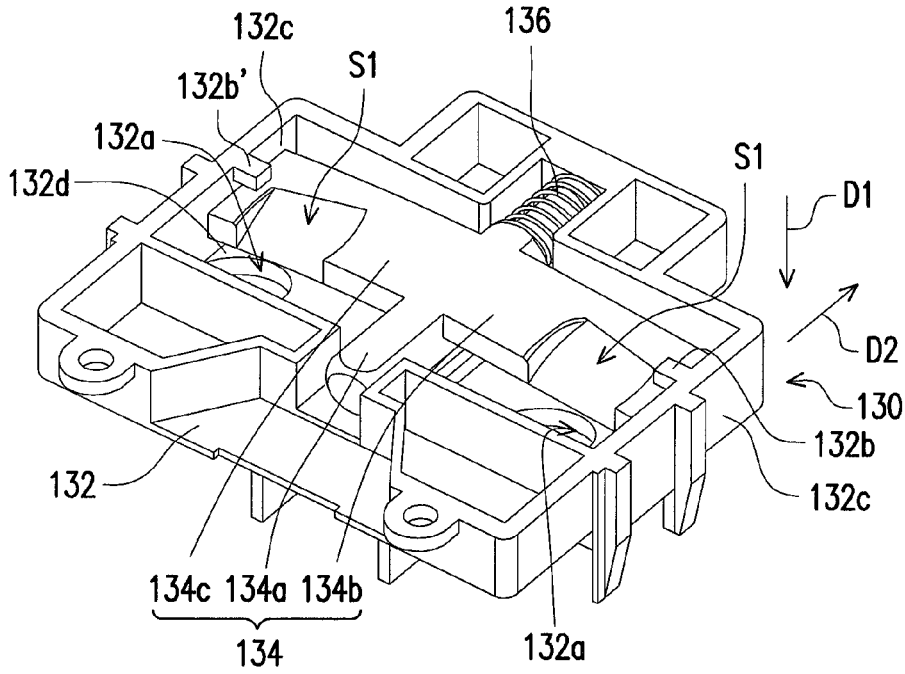
FIG. 5 is a diagram showing the sliding of the safety gate of FIG. 2.
Figure 6A:
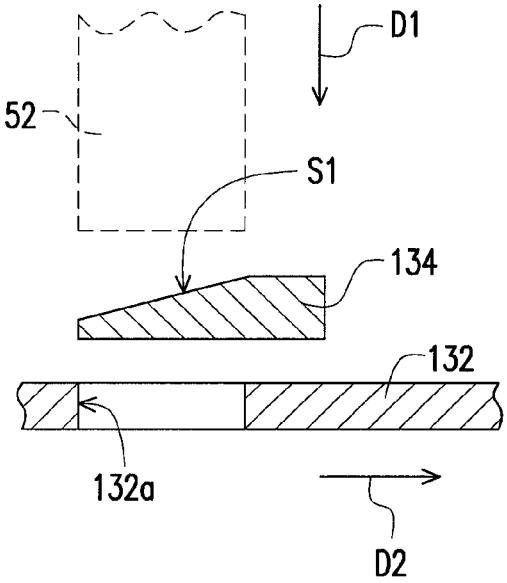
FIGS. 6A and 6B are partial cross-sectional diagrams of FIGS. 2 and 5.
Figure 6B:
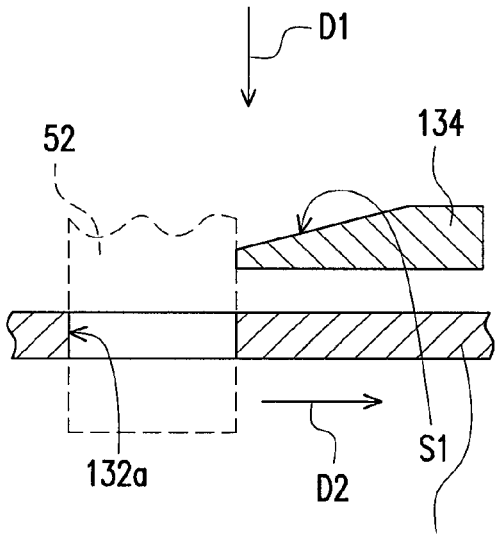

FIG. 4 is a diagram showing two terminals of a plug respectively insert the two openings in FIG. 1, FIG. 5 is a diagram showing the sliding of the safety gate of FIG. 2 and FIGS. 6A and 6B are partial cross-sectional diagrams of FIGS. 2 and 5. When the safety gate 134 is located the position shown by FIGS. 2 and 6A (referred as first protrusion), the safety gate 134 blocks the two inserted holes 132*a* and two terminals 52 of a plug 50 are allowed to insert the two openings 122 through the two openings 122 as shown by FIG. 4 so as to push the safety gate 134 sliding to the position as shown by FIGS. 5 and 6B (referred as second position) to expose the two inserted holes 132*a*. At the time, the two terminals as shown by FIG. 4 can be connected to the socket main body 110 through the two inserted holes 132*a*.

Figure 7:
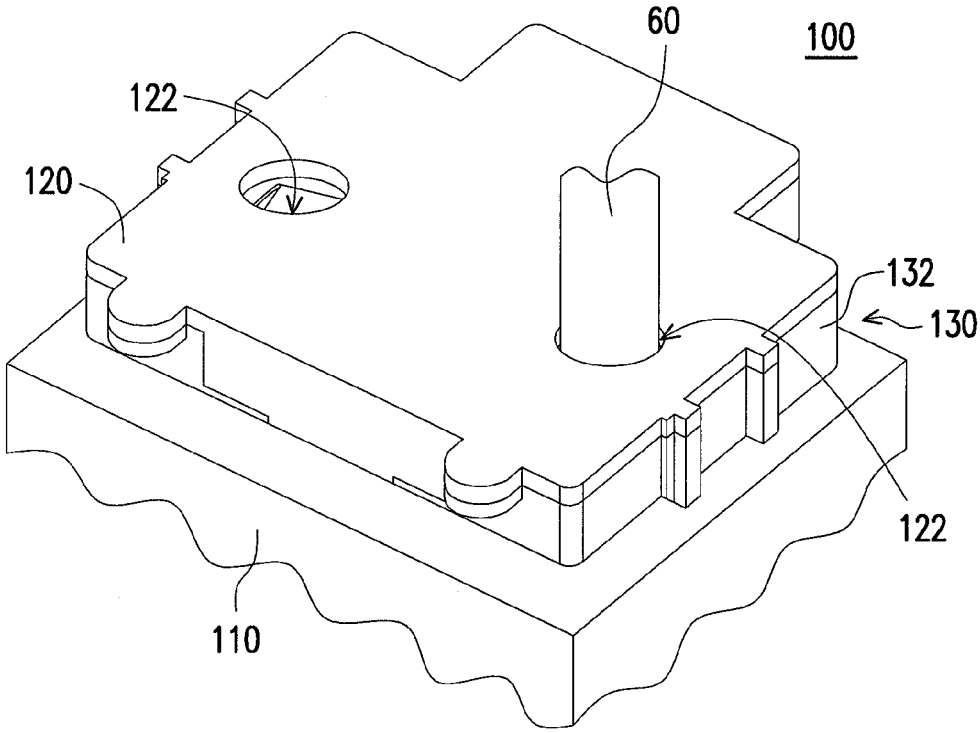
FIG. 7 is a diagram showing an object is inserted into an opening of FIG. 1.
Figure 8:
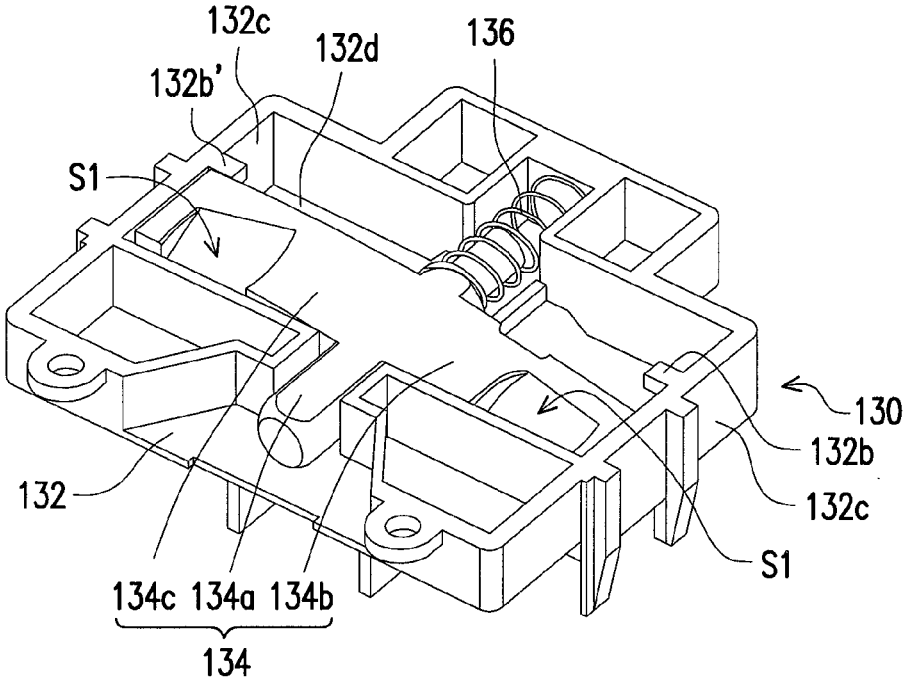
FIG. 8 is a diagram showing rotating of the safety gate in FIG. 2.

FIG. 7 is a diagram showing an object is inserted into an opening of FIG. 1 and FIG. 8 is a diagram showing rotating of the safety gate in FIG. 2. When an object 60 (such as metallic utensil) inserts one of the two openings 122 as shown by FIG. 7 to push the safety gate 134 through the openings 122, the safety gate 134 would rotate to drive a part of the safety gate 134 as shown by FIG. 8 to be aligned with one of the first protrusion 132*b* and the second protrusion 132*b*' (in FIG. 8, a part of the safety gate 134 is aligned with the second protrusion 132*b*'). In this way, by using the first protrusion 132*b* and the second protrusion 132*b*' to prevent the safety gate from sliding to the second position shown by FIG. 5 from the first position shown by FIG. 2, the two inserted holes 132*a* are avoided from exposing.

Under the above-mentioned layout, when the user insert the two terminals 52 of the plug 50 into the power socket 100 through the two openings 122 of the front cover 120, the two terminals 52 of the plug 50 would push the safety gate 134 of the safety gate mechanism 130 to move away the safety gate 134 from the two inserted holes 132*a* on the casing 132 of the safety gate mechanism 130 to allow the two terminals 52 insert the socket main body 110 through the two inserted holes 132*a*. In this way, the disposing of the safety gate mechanism 130 does not hinder the plug 50 from connecting the power socket 100. On the other hand, the casing 132 of the safety gate mechanism 130 has a protrusion 132*b*, when the user inserts an object 60 (such as metallic utensil) into the power socket 100 through one of the two openings 122 of the front cover 120, the object 60 pushes the safety gate 134 for rotating, so that the safety gate 134 is aligned with the first protrusion 132*b* or the second protrusion 132*b*' of the casing 132. By using the blocking of the first protrusion 132*b* and the second protrusion 132*b*' against the safety gate 134, the safety gate 134 is avoided to be pushed away from the inserted holes 132*a* of the casing 132 by the object 60, which can prevent the object 60 from entering the socket main body 110 to produce short circuit and damage the power socket 100 and thus the operation safety of the power socket 100 is advanced.

Figure 9:
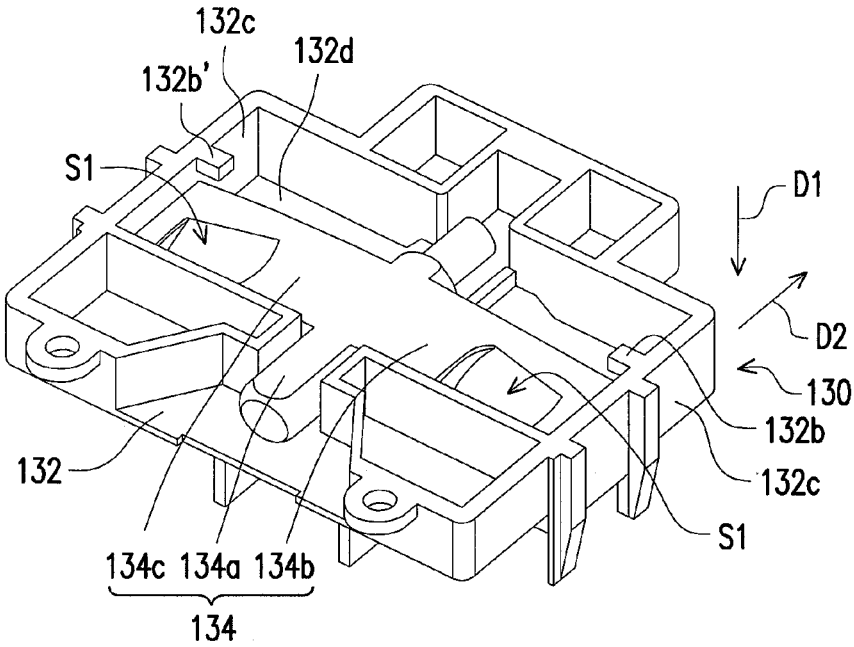
FIG. 9 is a schematic three-dimensional diagram of the safety gate mechanism according to another embodiment of the disclosure.

Referring to FIG. 2, in the embodiment, the safety gate mechanism 130 includes an elastic member 136, and the elastic member 136 is, for example, a compression spring and disposed between the safety gate 134 and the casing 132. When the safety gate 134 is applied by a force to be pushed to the second position as shown by FIG. 5 from the first position as shown by FIG. 2, the elastic member 136 is compressed to store an elastic potential energy. When the safety gate 134 is released from the force, the safety gate 134 would resume the position by means of the elastic force of the elastic member 136 to arrive at the first position as shown by FIG. 2 from the second position as shown by FIG. 5. FIG. 9 is a schematic three-dimensional diagram of the safety gate mechanism according to another embodiment of the disclosure. In the safety gate mechanism 130' as shown by FIG. 9, it is different from FIG. 2 where the safety gate mechanism 130 has the elastic member 136, the safety gate 134 of FIG. 9 can resumes the position by means of gravity or other appropriate ways, which the disclosure is not limited to.

Figure 10A:
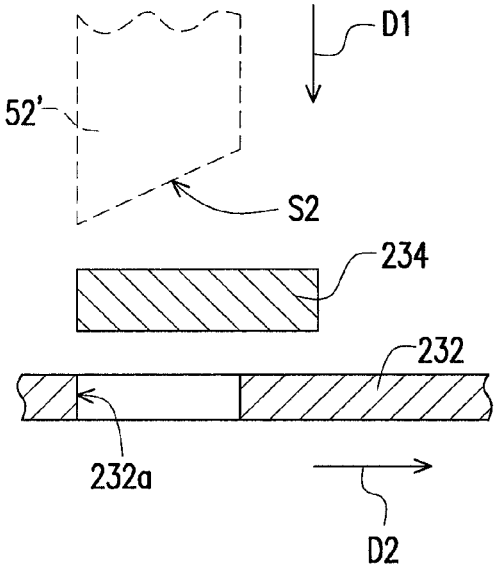
FIGS. 10A and 10B are cross-sectional diagrams showing the terminals push the safety gate according to another embodiment of the disclosure.
Figure 10B:
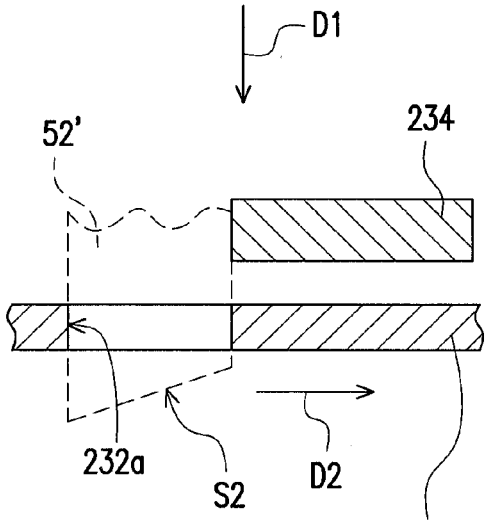

Referring to FIGS. 2 and 6A, in more details, the safety gate 134 in the embodiment has two sloped surfaces S1. When the two terminals 52 of the plug 50 (as shown by FIG. 4) are inserted into the two openings 122 along a direction D1, the two terminals 52 push the two sloped surfaces S1 of the safety gate 134 to drive the safety gate 134 for sliding along the direction D2 perpendicular to the direction D1 to the second position as shown by FIGS. 5 and 6B from the first position as shown by FIGS. 2 and 6A. FIGS. 10A and 10B are cross-sectional diagrams showing the terminals push the safety gate according to another embodiment of the disclosure. In the embodiment of FIGS. 10A and 10B, the terminals 52' have sloped surfaces S2, not like FIGS. 2 and 6A where the safety gate 134 has the sloped surfaces. When the terminals 52' move along the direction D1, the terminals 52' are configured to push the safety gate 234 to slide along the direction D2 to the position as shown by FIG. 10B (corresponding to the second position) from the position as shown by FIG. 10A by means of the sloped surfaces S2 so as to expose the inserted holes 232*a* of the casing 232 and enable the terminals 52' insert the inserted holes 232*a*. In other embodiments, the terminals can use other appropriate structure features to push the safety gate, which the disclosure is not limited to.

Referring to FIG. 2, in the embodiment, the safety gate 134 includes a pillaret 134*a*, a first side portion 134*b* and a second side portion 134*c*. The safety gate 134 uses the pillaret 134*a* thereof slidably to be disposed at the casing 132 and the safety gate 134 rotates around the pillaret 134*a* as shown by FIG. 8. The first side portion 134*b* and the second side portion 134*c* are respectively connected to the opposite two sides of the pillaret 134*a*. When the safety gate 134 is located at the first position as shown by FIG. 2, the first side portion 134*b* and the second side portion 134*c* are respectively aligned with the two openings 122 as shown by FIG. 1 and respectively block the two inserted holes 132*a* of the casing 132, and the two terminals 52 of the plug 50 push the sloped surface S1 on the first side portion 134*b* and the sloped surface S1 on the second side portion 134*c* to make the safety gate 134 slide to the second position as shown by FIG. 5 to expose the two inserted holes 132*a*. Since the first side portion 134*b* and the second side portion 134*c* are respectively located at the opposite two sides of the pillaret 134*a*, when the two terminals 52 simultaneously push the first side portion 134*b* and the second side portion 134*c*, the safety gate 134 will not rotate around the pillaret 134*a*, and thus, the safety gate 134 will not be blocked by the first protrusion 132*b* or the second protrusion 132*b'* and can smoothly slide to the above-mentioned second position.

Referring to FIG. 2 again, the casing 132 in the embodiment has opposite two side walls 132*c*, the safety gate 134 is disposed between the two side walls 132*c*, and the first protrusion 132*b* and the second protrusion 132*b'* are respectively disposed at the two side walls 132*c* so that the first side portion 134*b* and the second side portion 134*c* of the safety gate 134 are respectively adjacent to the first protrusion 132*b* or the second protrusion 132*b'*. In the embodiment, the casing 132 is made of, for example, plastic and the two side walls 132*c*, the first protrusion 132*b* and the second protrusion 132*b'* are integrally formed by using injection moulding. In addition to blocking the two inserted holes 132*a* of the casing 132, the first side portion 134*b* and the second side portion 134*c* of the safety gate 134 are further configured to be blocked by the first protrusion 132*b* or the second protrusion 132*b'*. Therefore, during fabricating the safety gate mechanism 130, there is no need to additionally form structure feature corresponding to the first protrusion 132*b* and the second protrusion 132*b'*, but the safety gate 134 is still able to be blocked by the first protrusion 132*b* or the second protrusion 132*b'*, which simplifies the process of the safety gate mechanism 130.

Figure 11A:
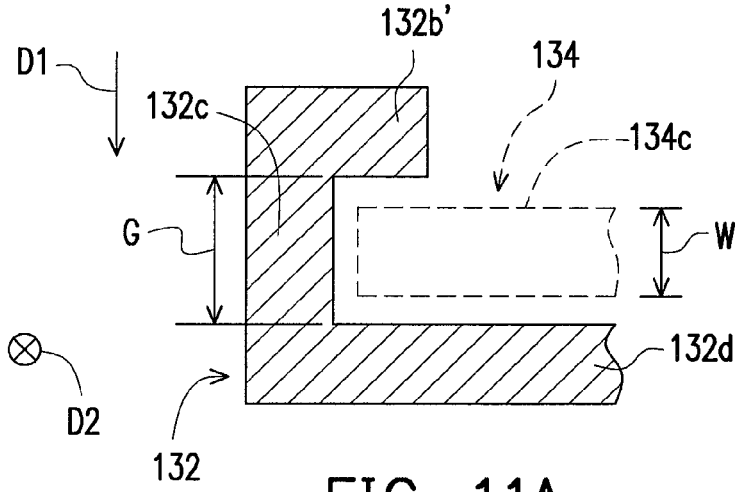
FIG. 11A is a partial cross-sectional diagram of the safety gate mechanism in FIG. 2.

FIG. 11A is a partial cross-sectional diagram of the safety gate mechanism in FIG. 2. Referring to FIGS. 2 and 11A, in the embodiment, the casing 132 has a bottom wall 132*d*, and the gap G between the second protrusion 132*b'* (or the first protrusion 132*b*) and the bottom wall 132*d* is greater than the thickness W of the safety gate 134. As a result, when the safety gate 134 is located at the first position as shown by FIG. 2 and is dislocated from the first protrusion 132*b* and the second protrusion 132*b'*, the safety gate 134 can slide to the second position as shown by FIG. 5 to expose the two inserted holes 132*a* by passing through the above-mentioned gap G.

Figure 11B:
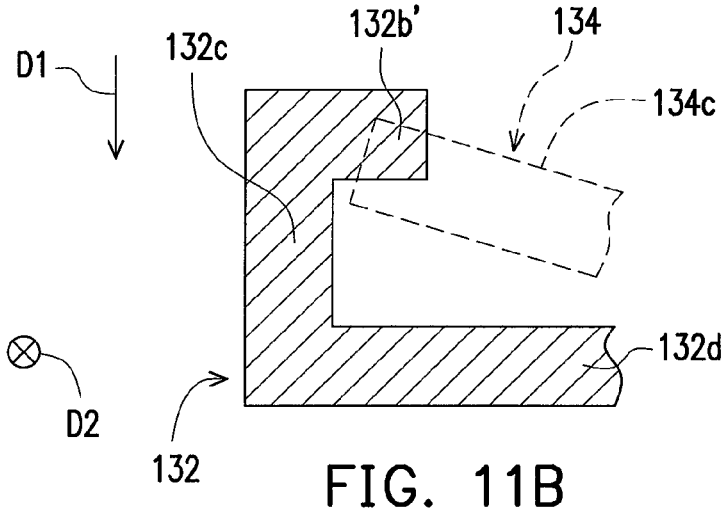
FIG. 11B is a partial cross-sectional diagram of the safety gate mechanism in FIG. 8.
Figure 12:
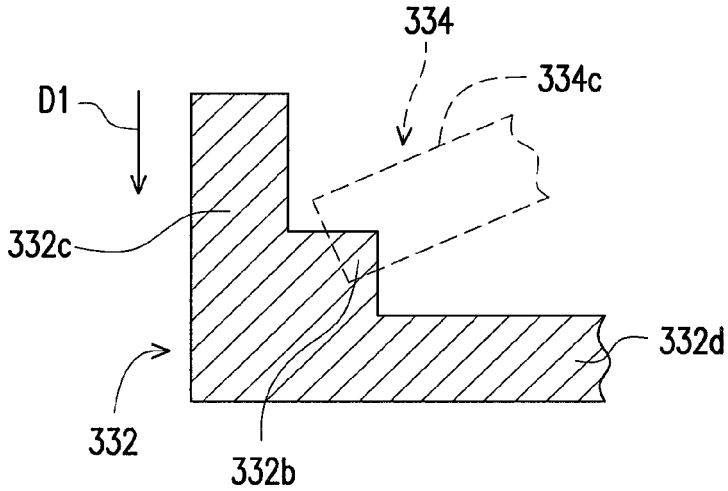
FIG. 12 is a partial cross-sectional diagram of a safety gate mechanism according to yet another embodiment of the disclosure.

In the embodiment, when the object 60 (as shown by FIG. 7) pushes the safety gate 134 for rotating, the first side portion 134*b* of the safety gate 134 is driven to be aligned with the first protrusion 132*b*, or the second side portion 134*c* of the safety gate 134 is driven to be aligned with the second protrusion 132*b'*, so that the safety gate 134 is blocked by the first protrusion 132*b* or the second protrusion 132*b'*. FIG. 11B is a partial cross-sectional diagram of the safety gate mechanism in FIG. 8. Taking an example, when the object 60 (as shown by FIG. 7) pushes the first side portion 134*b* of the safety gate 134 to make the safety gate 134 rotate as shown by FIG. 8, the second side portion 134*c* of the safety gate 134 is driven to be aligned with the second protrusion 132*b'* as shown by FIG. 11B, where the interference between the second protrusion 132*b'* and the second side portion 134*c* is used to block the safety gate 134. In other words, in the above-mentioned embodiment, when an end of the safety gate 134 (the first side portion 134*b*) is pushed, the other end (the second side portion 134*c*) of the safety gate 134 is blocked by the protrusion, which the disclosure is not limited to (referring to the description of FIG. 12). FIG. 12 is a partial cross-sectional diagram of a safety gate mechanism according to yet another embodiment of the disclosure. Referring to FIG. 12, in comparison with FIG. 11B where the second protrusion 132*b'* is disposed at the upper portion of the side wall 132*c*, in the embodiment of FIG. 12, the second protrusion 332*b'* of the casing 332 is disposed at the lower portion of the side wall 332*c* and adjacent to the bottom wall 332*d*. Thus, when the second side portion 334*c* of the safety gate 334 is downwards pushed by the object along the direction D1, the pushed end of the safety gate 134 (the second side portion 334*c*) is aligned with the second protrusion 332*b'* and is blocked by the second protrusion 332*b'* as well.

In summary, the power socket of the disclosure disposes a safety gate mechanism between the front cover and the socket main body thereof. When the user inserts two terminals of a plug into the power socket through the two openings of the front cover, the two terminals of the plug would push the safety gate of the safety gate mechanism to make the safety gate away from the two inserted holes on the casing of the safety gate mechanism, so that the two terminals can be inserted into the socket main body through the two inserted holes and the disposing the safety gate mechanism would not hinder the connection between the plug and the power socket. On the other hand, the casing of the safety gate mechanism has protrusions, and when the user inserts an object (such as metallic utensil) into the power socket through one of the two openings of the front cover, the object would push the safety gate to rotate to make the safety gate aligned with the protrusions of the casing so that the safety gate can be avoided to be pushed away from the inserted holes of the casing by the object by means of the blocking of the protrusions against the safety gate and it can prevent the object from entering the socket main body to damage the power socket by short circuit. In this way, the disclosure can advance the operation safety of the power socket. In addition, in addition to blocking the two inserted holes of the casing, the first side portion and the second side portion of the safety gate can be blocked by the protrusions on the casing. As a result, during fabricating the safety gate mechanism, there is no need to additionally form structure feature corresponding to the first protrusion and the second protrusion, but the safety gate is still able to be blocked by the protrusions, which simplifies the process of the safety gate mechanism.

It will be apparent to those skilled in the art that the descriptions above are several preferred embodiments of the disclosure only, which does not limit the implementing range of the disclosure. Various modifications and variations can be made to the structure of the disclosure without departing from the scope or spirit of the disclosure. The claim scope of the disclosure is defined by the claims hereinafter.

What is claimed is:

1. A power socket, comprising:

a socket main body;

a front cover, having two openings; and a safety gate mechanism, comprising:

a casing, disposed between the socket main body and the front cover and having two inserted holes and at least one protrusion, wherein the two inserted holes are disposed correspondingly to the socket main body and respectively aligned with the two openings; and a safety gate, slidably disposed at the casing and dislocated from the protrusion, wherein when the safety gate is located at a first position, the safety gate blocks the two inserted holes, and two terminals of a plug push the safety gate through the two openings to make the safety gate slide to a second position to expose the two inserted holes, wherein when an object pushes the safety gate through one of the two openings, the safety gate rotates to drive a part of the safety gate to be aligned with the protrusion so as to avoid exposing the two inserted holes.

2. The power socket as claimed in claim 1, wherein the safety gate mechanism further comprises an elastic member, the elastic member is disposed between the safety gate and the casing, and the safety gate is configured to position-resume to the first position from the second position by means of elastic force of the elastic member.

3. The power socket as claimed in claim 1, wherein the safety gate has two sloped surfaces, the two terminals push the two sloped surfaces to drive the safety gate sliding to the second position from the first position.

4. The power socket as claimed in claim 1, wherein each of the terminals has a sloped surface and the terminal is configured to push the safety gate by the sloped surface so as to drive the safety gate sliding to the second position from the first position.

5. The power socket as claimed in claim 1, wherein the safety gate comprises:

a pillaret, slidably disposed at the casing, wherein the safety gate rotates around the pillared; and a first side portion and a second side portion, respectively connected to opposite two sides of the pillaret, wherein when the safety gate is located at the first position, the first side portion and the second side portion are respectively aligned with the two openings, and the two terminals of the plug push the first side portion and the second side portion through the two openings so as to make the safety gate slide to the second position.

6. The power socket as claimed in claim 5, wherein quantity of the at least one protrusion is two and the protrusions comprise a first protrusion and a second protrusion, when the object pushes the safety gate through one of the two inserted holes, the safety gate rotates to drive the first side portion to be aligned with the first protrusion or drive the second side portion to be aligned with the second protrusion.

7. The power socket as claimed in claim 6, wherein the casing has opposite two side walls, the safety gate is disposed between the two side walls, and the first protrusion and the second protrusion are respectively disposed at the two side walls.

8. The power socket as claimed in claim 1, wherein the casing has a bottom wall, a gap between the protrusion and the bottom wall is greater than a thickness of the safety gate, when the safety gate is located at the first position and dislocated from the protrusion, the safety gate is configured to slide to the second position by passing the gap.

9. A safety gate mechanism, suitable to be used in a power socket, wherein the power socket comprises a front cover and a socket main body, the front cover has two openings, and the safety gate mechanism comprises:

a casing, disposed between the socket main body and the front cover and having two inserted holes and at least one protrusion, wherein the two inserted holes are disposed correspondingly to the socket main body and respectively aligned with the two openings; and a safety gate, slidably disposed at the casing and dislocated from the protrusion, wherein when the safety gate is located at a first position, the safety gate blocks the two inserted holes, and two terminals of a plug push the safety gate through the two openings to make the safety gate slide to a second position to expose the two inserted holes, wherein when an object pushes the safety gate through one of the two openings, the safety gate rotates to drive a part of the safety gate to be aligned with the protrusion so as to avoid exposing the two inserted holes.

10. The safety gate mechanism as claimed in claim 9, further comprising an elastic member, wherein the elastic member is disposed between the safety gate and the casing, and the safety gate is configured to position-resume to the first position from the second position by means of elastic force of the elastic member.

11. The safety gate mechanism as claimed in claim 9, wherein the safety gate has two sloped surfaces, the two terminals push the two sloped surfaces to drive the safety gate sliding to the second position from the first position.

12. The safety gate mechanism as claimed in claim 9, wherein each of the terminals has a sloped surface and the terminal is configured to push the safety gate by the sloped surface so as to drive the safety gate sliding to the second position from the first position.

13. The safety gate mechanism as claimed in claim 9, wherein the safety gate comprises:

a pillaret, slidably disposed at the casing, wherein the safety gate is configure to rotate around the pillaret; and a first side portion and a second side portion, respectively connected to opposite two sides of the pillaret, wherein when the safety gate is located at the first position, the first side portion and the second side portion are respectively aligned with the two openings, and the two terminals of the plug are configured to push the first side portion and the second side portion through the two openings so as to make the safety gate slide to the second position.

14. The safety gate mechanism as claimed in claim 13, wherein quantity of the at least one protrusion is two and the protrusions comprise a first protrusion and a second protrusion, when the object pushes the safety gate through one of the two inserted holes, the safety gate rotates to drive the first side portion to be aligned with the first protrusion or drive the second side portion to be aligned with the second protrusion.

15. The safety gate mechanism as claimed in claim 14, wherein the casing has opposite two side walls, the safety gate is disposed between the two side walls, and the first protrusion and the second protrusion are respectively disposed at the two side wall.

16. The safety gate mechanism as claimed in claim 9, wherein the casing has a bottom wall, a gap between the protrusion and the bottom wall is greater than a thickness of the safety gate, when the safety gate is located at the first position and dislocated from the protrusion, the safety gate is configured to slide to the second position by passing the gap.

* * * * *